United States Patent [19]

Grilliot et al.

[11] Patent Number: 4,918,756

[45] Date of Patent: Apr. 24, 1990

[54] WATERPROOF FIREFIGHTER'S GLOVE

[76] Inventors: William L. Grilliot; Mary I. Grilliot, both of 1986 Home Ave., Dayton, Ohio 45417

[21] Appl. No.: 278,214

[22] Filed: Nov. 30, 1988

[51] Int. Cl.[5] ..... A41D 19/00

[52] U.S. Cl. ..... 2/164; 2/159

[58] Field of Search ..... 2/163, 164, 158, 159, 2/167, 169, 161 R, 272, 275, 16, 20, 21

[56] References Cited

U.S. PATENT DOCUMENTS

| | | | |
|---|---|---|---|
| 2,072,541 | 3/1937 | Burnham | 2/164 |
| 2,578,188 | 12/1951 | Ionides et al. | 2/167 X |
| 3,098,237 | 7/1963 | Slimovitz | 2/164 |
| 3,114,915 | 12/1963 | Gross | 2/158 |
| 4,197,592 | 4/1980 | Klein | 2/161 A |
| 4,355,424 | 10/1982 | McCoy, Jr. | 2/161 R |
| 4,430,759 | 2/1984 | Jackrel | 2/159 |
| 4,454,611 | 6/1984 | Tschirch et al. | 2/161 R |
| 4,545,841 | 10/1985 | Jackrel | 2/159 X |
| 4,583,248 | 4/1986 | Edwards et al. | 2/164 |
| 4,679,257 | 7/1987 | Town | 2/164 |
| 4,847,918 | 7/1989 | Sturm | 2/164 X |

FOREIGN PATENT DOCUMENTS

| | | | |
|---|---|---|---|
| 2215179 | 1/1973 | France | 2/161 R |

*Primary Examiner*—Werner H. Schroeder
*Assistant Examiner*—Sara M. Current
*Attorney, Agent, or Firm*—Jacox & Meckstroth

[57] ABSTRACT

A firefighter's glove which is waterproof. The glove has a plurality of layers. One of the layers is of waterproof material. The waterproof layer is attached to a thermal barrier layer which is within the waterproof layer. A sealing piece covers the attachment portion of the waterproof layer and prevents water from entering the waterproof layer at the attachment portion. The sealing piece is also attached to an abrasion resistant layer which covers the waterproof layer. Thus, the layers are attached together, and water is prevented from entering the waterproof layer.

24 Claims, 2 Drawing Sheets

WATERPROOF FIREFIGHTER'S GLOVE

BACKGROUND OF THE INVENTION

A firefighter's gloves must protect the firefighter against the hostile environment within which the firefighter works during the fighting of a fire. A firefighter's gloves must have abrasion and flame resistance, moisture resistance, and thermal resistance.

A problem has long existed in construction of a firefighter's glove. The glove must be waterproof. Therefore, a layer of waterproof or moisture barrier material must be a part of the glove. Customarily, the layer of waterproof or moisture barrier material is positioned as an insert within a glove shell which is abrasion and flame resistant. Within the insert of waterproof material is an insert of thermal barrier material. In many gloves of firefighters, in order to maintain the layer or insert of waterproof material without attachment holes, the layer of waterproof material has not been attached to any other layer within the firefighter's glove. A major problem exists in such an arrangement. When a firefighter's sweaty hand is withdrawn from the glove, one or both of the inserts or layers is usually withdrawn from the outer shell. When the firefighter attempted to again don the glove, it was necessary to spend time reworking the inserts or layers back into the glove. Of course this type of situation is objectionable.

Stitching means and methods are considered best in attaching together layers in a firefighter's glove. Attempts have been made to attach the inserts or inner layers to the outer shell by stitching means. Stitching has been employed to attach a moisture barrier layer or insert to an outer shell of a glove. However, in the past, known stitching means has created holes within the moisture barrier layer. Holes permit water to enter the moisture barrier layer. Therefore, with such problems considered, stitching has not been a suitable method of attaching a moisture barrier layer to the outer shell.

Some firefighters' gloves have had the moisture barrier insert or layer adhesively attached to the outer shell. However, in firefighting conditions, such adhesive attachment has been short-lived and has not been effective.

Another attempt to provide a waterproof firefighter's glove has resulted in a glove in which the moisture resistant insert was provided with a nipple on the end of each finger of the insert. The nipple was stitched to the outer shell, with the inner liner or thermal insert glued to the moisture resistant insert. However, such attachment means was short-lived, and the problem was not solved.

In another attempt to solve the problem, the waterproof or moisture barrier insert or layer was turned inside-out and a nipple thereon wa stitched to the inner thermal layer, with the thermal barrier layer within the moisture barrier layer. Then the moisture barrier insert or layer was glued to the outer shell. However, this structure has not been effective, and the problem not solved.

U.S. Pat. No. 4,679,257 shows a glove structure in which a tab of plastics material extends outwardly from an opening within a moisture barrier layer. A thermal barrier layer is within the moisture barrier layer. A part of the tab which is within the moisture barrier insert is attached to a thermal barrier layer. The tab extends outwardly from the moisture barrier insert and is attached to the outer shell. The moisture barrier layer is sealed at the opening therein, so that the opening is closed, and the tab is sealingly attached to the moisture barrier layer. Thus, the tab attaches together the inner layer, the moisture barrier layer and the outer shell. However, leakage problems and other problems have existed in this structure.

It is an object of this invention to provide a firefighter's glove which is waterproof.

It is another object of this invention to provide such a firefighter's waterproof glove in which there is a moisture barrier layer and a thermal barrier layer within a flame resistant shell and in which the layers and the shell are secured together without permitting entrance of water into the moisture barrier layer.

It is another object of this invention to provide a firefighter's glove in which stitching is employed in attaching a moisture barrier layer to an outer shell of the glove. Thus, the preferred method of attachment (stitching) is employed while maintaining a waterproof glove.

It is another object of this invention to provide such a firefighter's waterproof glove which can be produced at relatively low costs and which is long-lived.

Other objects and advantages of this invention reside in the construction of parts, the combination thereof, the method of production and the mode of use as will become more apparent from the following description.

SUMMARY OF THE INVENTION

This invention comprises a firefighter's glove which includes an outer shell or layer, which is flame resistant and abrasion resistant, an intermediate layer which is a moisture barrier, and an inner layer which is a thermal barrier. Each layer is in the form of a glove, with a body part and finger parts. The glove is constructed to be waterproof, even though the layers are attached together. Connection means connect the moisture barrier intermediate layer to the outer shell, and attachment means attach the thermal barrier inner layer to the moisture barrier intermediate layer. Thus, the moisture barrier intermediate layer and the inner layer are secure within the outer shell. In this construction, each finger part of the moisture barrier intermediate layer is stitched to a respective finger part of the thermal barrier inner layer. A strip or piece of waterproof material is adhesively attached to the outer surface of each finger part of the moisture barrier intermediate layer. The strip covers the stitches and thus seals the moisture barrier intermediate layer against entrance of water into the moisture barrier intermediate layer. Each strip has an extension portion which is attached to the inner surface of a respective finger part of the outer shell of the glove. Therefore, the moisture barrier intermediate layer is protected against entrance of water while being secured to the outer layer, and the thermal barrier inner layer is attached to the moisture barrier intermediate layer. Thus, while the glove is waterproof, the firefighter's hand can be easily donned and readily withdrawn from the glove without separation of the inner layer or intermediate layer from the outer layer.

DETAILED DESCRIPTION OF THE PREFERRED EMBODIMENT

Figure 1:
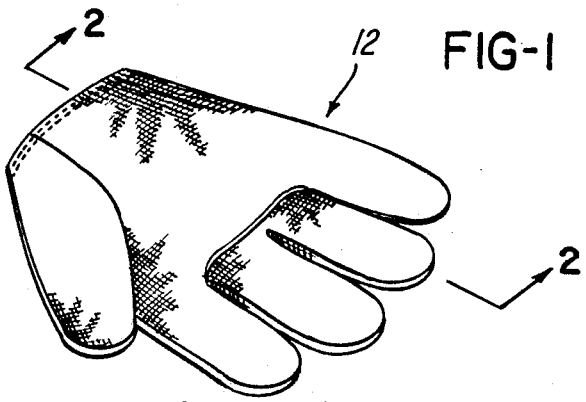
FIG. 1 is a perspective view illustrating a firefighter's waterproof glove of this invention.
Figure 3:
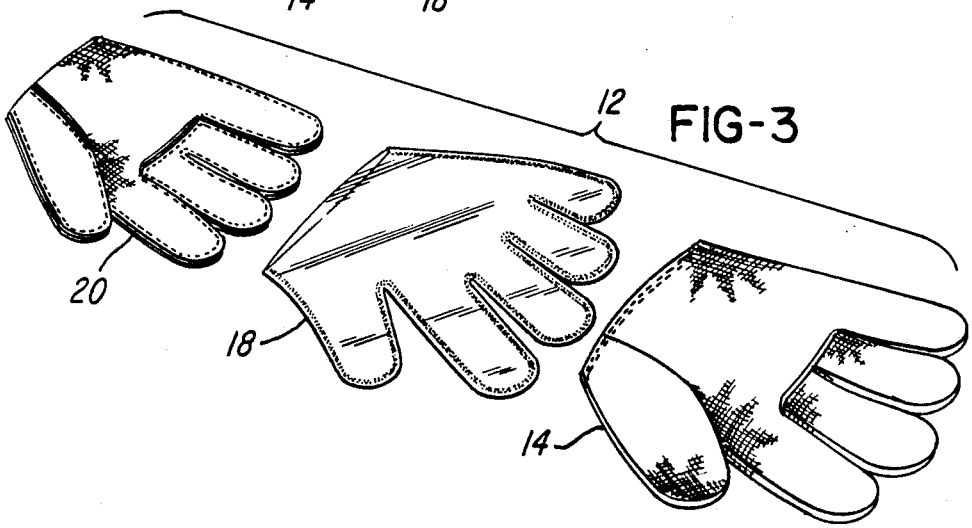
FIG. 3 is an exploded perspective view drawn on substantially the same scale as FIG. 1, showing the layers which comprise a firefighter's glove of this invention.

FIG. 1 shows the exterior of a firefighter's glove 12 of this invention. As illustrated in FIG. 3, the firefighter's glove 12 of this invention comprises an outer shell or layer 14, which is flame resistant and abrasion resistant. The glove 12 also comprises an intermediate layer 18, which is a moisture barrier. The intermediate layer 18 may be, for example, a relatively thin impervious plastics material. The glove 12 also comprises an inner layer 20, which is a thermal barrier. Each of the layers 14, 18, and 20 is in the form of a glove and has a plurality of finger portions and a body portion.

Figure 4:
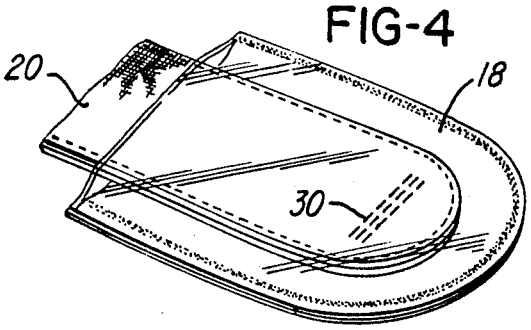
FIG. 4 is a greatly enlarged fragmentary perspective view showing parts of a finger portion of a firefighter's glove of this invention and illustrating one of the initial steps in the construction of the firefighter's glove.

FIG. 4 illustrates an initial step in the construction of a firefighter's glove 12 of this invention. FIG. 4 shows a part of a finger portion of the firefighter's glove 12. A finger portion of the inner layer 20 is positioned within the finger portion of the intermediate layer 18. As shown in FIG. 4, stitches 30 attach together the intermediate layer 18 and the inner layer 20. The stitches 30 extend through opposed surfaces of the intermediate layer 18 and the inner layer 20.

Figure 5:
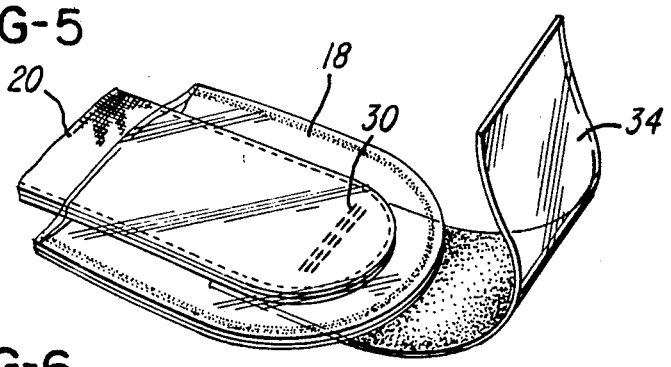
FIG. 5 is a fragmentary perspective view, showing parts of a finger portion of a firefighter's glove of this invention, drawn on substantially the same scale as FIG. 4, illustrating a further step in construction of the firefighter's glove.
Figure 6:
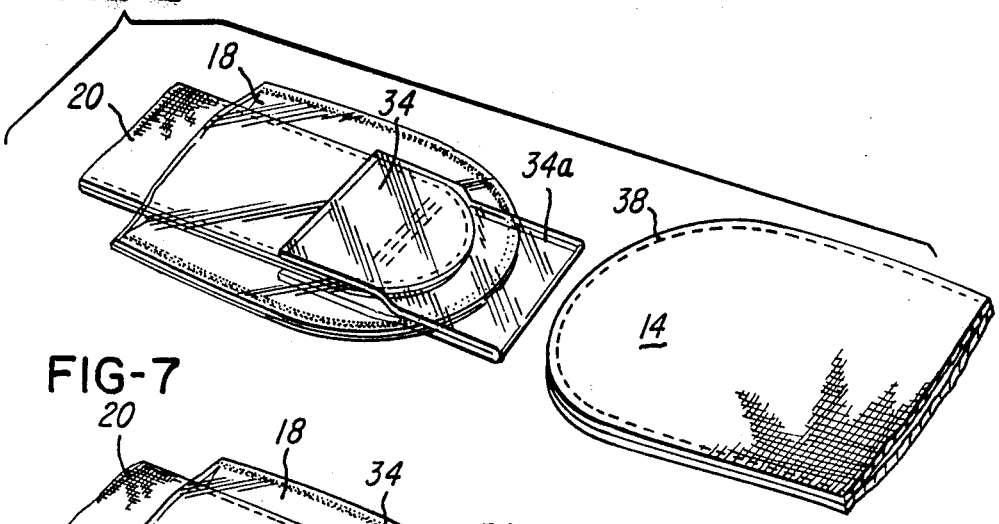
FIG. 6 is a fragmentary perspective view, showing parts of a finger portion of a firefighter's glove of this invention, drawn on substantially the same scale as FIGS. 4 and 5, illustrating a further step in construction of the firefighter's glove.

As shown in FIGS. 5 and 6, a strip 34 of sealing material, such as an impervious plastics material or the like is attached to opposed surfaces of the intermediate layer 18 by any suitable adhesive means, such as by an adhesive material or by heat sealing, or the like. The strip 34 is shown as being folded. The strip 34 covers opposed surfaces of the intermediate layer 18, and has an extension part 34*a*, shown in FIGS. 6 and 7.

Figure 7:
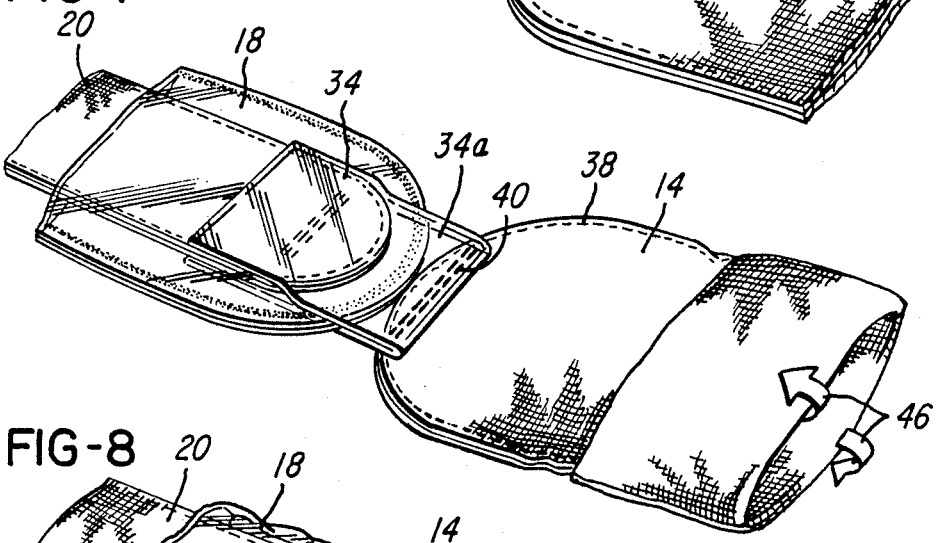
FIG. 7 is a fragmentary perspective view, showing parts of a finger portion of a firefighter's glove of this invention, drawn on substantially the same scale as FIGS. 4, 5, and 6, illustrating a further step in construction of the firefighter's glove
Figure 8:
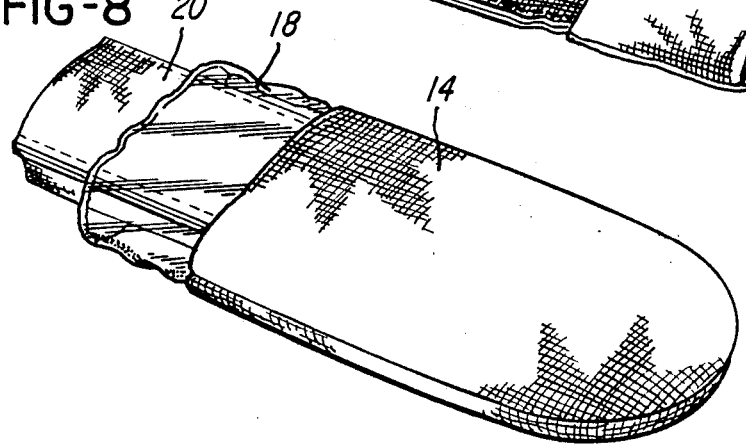
FIG. 8 is a fragmentary perspective view, showing parts of a finger portion of a firefighter's glove of this invention, drawn on substantially the same scale as FIGS. 4, 5, 6 and 7, illustrating a further step in construction of the firefighter's glove.

In the next step in the construction of the glove 12, the outer shell 14 is turned inside-out, as shown in FIG. 6. The outer shell 14 is shown as having inside stitches 38 at the edges thereof, as the stitches 38 attach parts of the outer shell 14 together. Then, as shown in FIG. 7, the extension part 34*a* of the strip 34 is attached to the outer shell 14, by any suitable means, such as by stitches 40. Then, as illustrated by arrows 46 in FIG. 7, the outer shell 14 is turned back to right-side out, as the outer shell 14 encloses the intermediate layer 18 and the inner layer 20, as illustrated in FIGS. 2 and 8.

Figure 2:
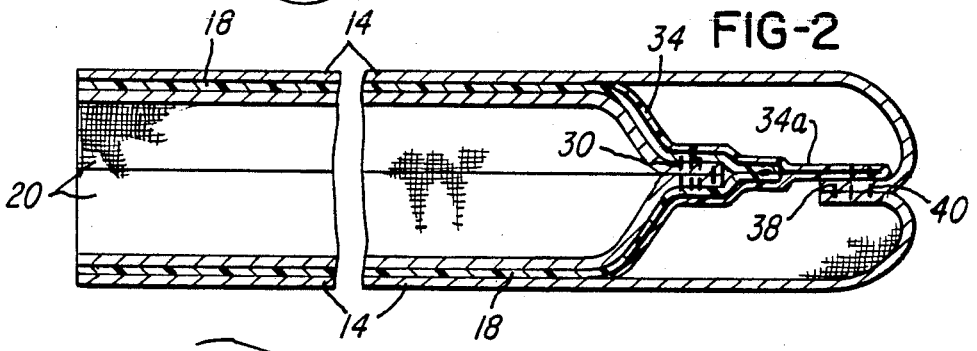
FIG. 2 is a qreatly enlarged sectional view, with parts broken away, taken substantially on line 2—2 of FIG. 1.

Thus, as best shown in FIG. 2, the stitches 30, which attach together the inner layer 20 and the intermediate layer 18, are sealingly covered by the strip 34. Thus, the intermediate layer 18 is maintained as a waterproof moisture barrier, without the possibility of water entering the intermediate layer 18 through the finger portions thereof. Furthermore, as best illustrated in FIGS. 2 and 7, the strip 34 is attached to the outer layer or shell 14. Thus, the layers 14, 18, and 20 are secured together by stitching, which is a preferred means and method, while maintaining the moisture barrier layer 18 as a waterproof layer. Thus, the firefighter's glove 12 is a waterproof glove.

The method of construction, shown and discussed, which attaches together the outer layer 14, the intermediate layer 18, and the inner layer 20, assures the firefighter who wears the waterproof glove 12, that removal of the glove 12 from the firefighter's hand and entrance of the firefighter's hand into the glove 12 are accomplished easily and readily, as all of the layers 14, 18, and 20 remain together at all times.

Although the preferred embodiment of the firefighter's glove of this invention has been described, it will be understood that within the purview of this invention various changes may be mad in the form, details, proportion and arrangement of parts, and the combination thereof, which generally stated consist in a structure and method within the scope of the appended claims.

The invention having thus been described, the following is claimed.

1. A firefighter's waterproof glove comprising an outer layer of flame resistant and abrasion resistant material, an intermediate layer of moisture barrier material, and an inner layer of thermal barrier material, each of the layers having a finger portion, attachment means attaching together the finger portion of the inner layer and the finger portion of the intermediate layer, sealing means covering the attachment means, and securing means attaching the sealing means to the outer layer, whereby the relative positions of the layers is maintained and the intermediate layer is sealed against entrance of fluid at the finger portion thereof.

2. The firefighter's glove of claim 1 in which the attachment means comprises stitching means.

3. The firefighter's glove of claim 1 in which the sealing means comprises a piece of waterproof material.

4. The firefighter's glove of claim 1 in which the sealing means comprises strip material and the securing means comprises stitching means which attach the strip material to the outer layer.

5. The firefighter's glove of claim 1 in which the attachment means comprises stitching means and in which the sealing means comprises a strip of plastics material which is sealed to the intermediate layer and covers the stitching means.

6. A firefighter's waterproof glove comprising an outer layer of abrasion resistant material, an intermediate layer of waterproof material, and an inner layer of thermal barrier material, stitching means extending through the intermediate layer and through the inner layer and attaching together the intermediate layer and the inner layer, sealing means sealingly attached to the intermediate layer and covering the stitching means, and securing means attaching the sealing means to the outer layer, whereby the layers are secured in desired relative positions as a firefighter's hand enters and withdraws from the inner layer of the glove and whereby the intermediate layer is maintained as a waterproof barrier as water is prevented from passage through the stitching means.

7. The firefighter's glove of claim 6 in which each of the layers has a finger portion and in which the stitching means extends through the finger portion of the intermediate layer and through the finger portion of the inner layer, and the sealing means covers a part of the finger portion of the intermediate layer and covers the stitching means which extend therethrough.

8. The firefighter's glove of claim 6 in which each of the layers has a plurality of finger portions, and in which stitching means extends through each finger portion of the intermediate layer and through each complementary finger portion of the inner layer, and in which sealing means covers a part of each finger portion of the intermediate layer and covers the stitching means which extend therethrough.

9. The method of construction of a firefighter's waterproof glove comprising inserting a layer of thermal insulation material within a layer of waterproof material, stitching the layers together at a stitch position, covering the layer of waterproof material at the stitch position with a piece of waterproof material, sealingly attaching the piece of waterproof material to the layer of waterproof material, covering the layer of waterproof material and the piece of waterproof material with a layer of abrasion resistant material, attaching the piece of waterproof material to the layer of abrasion resistant material, whereby the layers are maintained in desired relative relationship while maintaining the layer of waterproof material in a waterproof condition.

10. The method of claim 9 in which each layer is in the form of an enclosure for a firefighter's hand and includes a finger portion, and in which the layer of thermal insulation material and the layer of waterproof material are attached together by stitching at the finger portions thereof, and in which the piece of waterproof material is attached to the finger portion of the layer of abrasion resistant material.

11. The method of construction of a waterproof glove for a firefighter's hand comprising forming a glove-shape layer of thermal barrier material, forming a glove-shape layer of moisture barrier material, assembling the glove-shape layer of moisture barrier material and the glove-shape layer of thermal barrier material with one of the glove-shape layers within the other glove-shape layer, wherein one of these two layers is an outer layer and one of the two layers is an inner layer, attaching together the glove-shape layer of moisture barrier material and the glove-shape layer of thermal barrier material to form an attachment region in both of the two layers, covering the attachment region of one of the layers with a piece of moisture resistant material and attaching the piece of moisture resistant material thereto, forming a glove-shape layer of abrasion resistant material, attaching the piece of moisture resistant material to the glove-shape layer of abrasion resistant material, and positioning the glove-shape layer of abrasion resistant material over the outer layer of glove-shape material, whereby all of the layers are secured in desired relative positions, and whereby a firefighter's hand within the inner layer is protected against passage of wate through the layers.

12. The method of claim 1 in which the glove-shape layer of moisture barrier material and the glove-shape layer of thermal barrier material are assembled with the glove-shape layer of thermal barrier material within the glove-shape layer of moisture barrier material, whereby the glove-shape layer of moisture barrier material comprises the outer layer.

13. The method of claim 11 in which the glove-shape layer of thermal barrier material is assembled within the glove-shape layer of moisture barrier material, wherein the glove-shape layer of moisture barrier material is the outer layer, each of the glove-shape layers including a finger portion, and in which the method includes stitching together the finger portion of the glove-shape layer of moisture barrier material and the finger portion of the glove-shape layer of the thermal barrier material and in which the method includes stitching the piece of moisture resistant material to the glove-shape layer of abrasion resistant material.

14. The method of claim 11 in which each of the glove-shape layers includes a finger portion, and in which the method includes stitching together the finger portion of the glove-shape layer of moisture barrier material and th finger portion of the glove-shape layer of thermal barrier material and in which the method includes stitching the piece of moisture resistant material to the finger portion of the glove-shape layer of abrasion resistant material.

15. A firefighter's waterproof glove comprising a glove-shape layer of flame resistant material, a glove-shape layer of moisture barrier material, and a glove-shape layer of thermal barrier material, each of the layers having a finger portion, the glove-shape layer of thermal barrier material being positioned within the glove-shape layer of moisture barrier material, the glove-shape layer of moisture barrier material being positioned within the glove-shape layer of flame resistant material, attachment means attaching together the finger portion of the layer of moisture barrier material and the finger portion of the layer of thermal barrier material, the attachment means extending through the finger portion of the glove-shape layer of moisture barrier material and through the finger portion of the glove-shape layer of thermal barrier material, a piece of moisture barrier material covering the attachment means and being sealingly attached to the finger portion of the glove-shape layer of moisture barrier material, and connection means connecting the piece of moisture barrier material to the finger portion of the glove-shape layer of flame resistant material, whereby the relative positions of the glove-shape layers of material is maintained and whereby the glove-shape layer of moisture barrier material is maintained against passage of moisture thereinto.

16. The firefighter's waterproof glove of claim 15 in which the connection means connecting the piece of moisture barrier material to the finger portion of the glove-shape layer of flame resistant material includes stitch means.

17. The firefighter's waterproof glove of claim 15 in which the attachment means attaching together the finger portion of the layer of moisture barrier material and the finger portion of the layer of thermal barrier material comprises stitch means.

18. A firefighter's waterproof glove comprising a glove-shape layer of flame resistant material, a glove-shape layer of moisture barrier material, and a glove-shape layer of thermal barrier material, each of the layers having a finger portion, the glove-shape layer of thermal barrier material being positioned within the glove-shape layer of moisture barrier material, the glove-shape layer of moisture barrier material being positioned within the glove-shape layer of flame resistant material, the finger portion of the glove-shape layer of moisture barrier material having opposed surfaces, attachment means attaching together the finger portion of the moisture barrier material and the finger portion of the thermal barrier material, the attachment means extending through the finger portion of the glove-shape layer of moisture barrier material and through the finger portion of the glove-shape layer of thermal barrier material, the attachment means having a portion thereof at each of the opposed surfaces of the finger portion of the glove-shape layer of moisture barrier material, a piece of moisture barrier material covering the attachment means at each of the opposed surfaces of the finger portion of the glove-shape layer of moisture barrier material and sealingly attached to the opposed surfaces of the finger portion of the glove-shape layer of moisture barrier material, and connection means connecting the piece of moisture barrier material to the finger portion of the glove-shape layer of flame resistant material, whereby the relative positions of the glove-shape layers of material is maintained and whereby the glove-shape layer of moisture barrier material is maintained against passage of moisture thereinto.

19. The firefighter's waterproof glove of claim 18 in which the connection means connecting the piece of moisture barrier material to the finger portion of the glove-shape layer of flame resistant material includes stitch means.

20. The firefighter's waterproof glove of claim 18 in which the attachment means attaching together the finger portion of the moisture barrier material and the finger portion of the thermal barrier material comprises stitch means.

21. The method of producing a waterproof glove for a firefighter comprising forming a glove-shape layer of thermal barrier material, forming a glove-shape layer of moisture barrier material, enclosing the glove-shape layer of thermal barrier material within the glove-shape layer of moisture barrier material, attaching the glove-shape layer of thermal barrier material to the glove-shape layer of moisture barrier material and thus forming an attachment region in the glove-shape layer of moisture barrier material and in the glove-shape layer of thermal barrier material, covering the attachment region in the glove-shape layer of moisture barrier material with a piece of moisture resistant material, forming a glove-shape layer of abrasion resistant material in which the glove-shape layer of abrasion resistant material has an inside surface and an outside surface, turning the glove-shape layer of abrasion resistant material to a condition in which the inside surface thereof is an exterior surface and the outside surface thereof is an interior surface, attaching the piece of moisture resistant material to the inner surface of the glove-shape layer of abrasion resistant material, followed by turning the glove-shape layer of abrasion resistant material to a condition in which the inside surface thereof is an interior surface and the outside surface thereof is an exterior surface, followed by covering the glove-shape layer of moisture barrier material with the glove-shape layer of abrasion resistant material, whereby all of the layers are secured in desired relative positions and the attachment region is sealed against passage of water through the glove-shape layer of moisture barrier material.

22. The method of claim 21 in which each of the layers has a finger portion and in which the finger portion of the glove-shape layer of moisture barrier material and the finger portion of the glove-shape layer of thermal barrier material are attached together and in which the piece of moisture resistant material is attached to the finger portion of the glove-shape layer of abrasion resistant material.

23. The method of claim 21 in which the glove-shape layer of thermal barrier material is attached to the glove-shape layer of moisture barrier material by a stitching process.

24. The method of claim 21 in which the piece of moisture resistant material is attached to the inner surface of the glove-shape layer of abrasion resistant material by a stitching process.

* * * * *

UNITED STATES PATENT AND TRADEMARK OFFICE

CERTIFICATE OF CORRECTION

PATENT NO. : 4,918,756

DATED : April 24, 1990

INVENTOR(S) : William L. Grilliot and Mary I. Grilliot

It is certified that error appears in the above-identified patent and that said Letters Patent is hereby corrected as shown below:

Column 1, line 55, change "wa" to ---was---.

Column 1, line 59, after "problem" insert ---was---.

Column 4, line 27, change "mad" to ---made---.

Column 5, line 65, change "wate" to ---water---.

Column 5, line 66, change "1" to ---11---.

Column 6, line 21, change "th" to ---the---.

Signed and Sealed this

Ninth Day of July, 1991

*Attest:*

HARRY F. MANBECK, JR.

*Attesting Officer*

*Commissioner of Patents and Trademarks*